US012203473B2

(12) United States Patent
Loehmer

(10) Patent No.: US 12,203,473 B2
(45) Date of Patent: Jan. 21, 2025

(54) FILTER-AND-THROTTLE UNIT FOR A SCROLL COMPRESSOR, AND SCROLL COMPRESSOR FOR A REFRIGERANT CIRCUIT

(71) Applicant: PIERBURG GMBH, Neuss (DE)

(72) Inventor: Lukas Loehmer, Duesseldorf (DE)

(73) Assignee: PIERBURG GMBH, Neuss (DE)

( * ) Notice: Subject to any disclaimer, the term of this patent is extended or adjusted under 35 U.S.C. 154(b) by 0 days.

(21) Appl. No.: 18/030,777

(22) PCT Filed: Oct. 8, 2020

(86) PCT No.: PCT/EP2020/078292

§ 371 (c)(1),
(2) Date: May 4, 2023

(87) PCT Pub. No.: WO2022/073611

PCT Pub. Date: Apr. 14, 2022

(65) Prior Publication Data

US 2023/0374988 A1 Nov. 23, 2023

(51) Int. Cl.

| | |
|---|---|
| ***F04C 29/00*** | (2006.01) |
| ***F04C 18/02*** | (2006.01) |
| ***F04C 27/00*** | (2006.01) |
| ***F04C 29/02*** | (2006.01) |

(52) U.S. Cl.

CPC ..... *F04C 29/0092* (2013.01); *F04C 18/0215* (2013.01); *F04C 27/008* (2013.01); *F04C 29/026* (2013.01); *F04C 2210/00* (2013.01); *F04C 2240/80* (2013.01)

(58) Field of Classification Search

CPC ..... F04C 29/0092; F04C 18/0215; F04C 27/008; F04C 29/026; F04C 2210/00; F04C 2240/80

See application file for complete search history.

(56) References Cited

U.S. PATENT DOCUMENTS

| | | | | |
|---|---|---|---|---|
| 7,195,470 | B2 * | 3/2007 | Kimura | F04C 29/026 418/55.6 |
| 8,202,071 | B2 * | 6/2012 | Kii | F04C 29/026 418/55.6 |
| 2005/0129556 | A1 | 6/2005 | Ito | |

(Continued)

FOREIGN PATENT DOCUMENTS

| | | |
|---|---|---|
| CN | 203035552 U | 7/2013 |
| CN | 210317748 U | 4/2020 |

(Continued)

OTHER PUBLICATIONS

Foreign Patent and Machine Translation for CN 20303552 U; Inventor: Chen et al; Title: Scroll Compressor; Published: Jul. 3, 2013. (Year: 2013).*

(Continued)

*Primary Examiner* — Mary A Davis
(74) *Attorney, Agent, or Firm* — Norman B. Thot

(57) ABSTRACT

A filter and throttle unit for a scroll compressor. The filter and throttle unit includes a housing which has housing walls, an opening which acts as a throttle, and a filter element which is arranged within the housing walls of the housing. The opening is arranged in one of the housing walls.

13 Claims, 3 Drawing Sheets

(56) References Cited

U.S. PATENT DOCUMENTS

| | | | | |
|---|---|---|---|---|
| 2013/0280115 | A1* | 10/2013 | Kawamura | F04C 18/0215 418/55.1 |
| 2015/0048022 | A1* | 2/2015 | Odell | B29D 28/00 29/428 |
| 2018/0335032 | A1 | 11/2018 | Obrist et al. | |

FOREIGN PATENT DOCUMENTS

| | | | |
|---|---|---|---|
| EP | 3 404 264 | A1 | 11/2018 |
| JP | 2005-61326 | A | 3/2005 |
| JP | 2008-190448 | A | 8/2008 |

OTHER PUBLICATIONS

Foreign Patent Publication and Machine Translation for JP-2007-9770; Inventor: SATO et al; Title: Scroll Compressor, Published: Jan. 18, 2007. (Year: 2007).*

Foreign Patent and Machine Translation for JP 2001-304144A; Inventor: Tanaka, Title: Horizontal Scroll Compressor, Published Oct. 31, 2001. (Year: 2001).*

Machine Translation of Foreign Patent Publication EP 3,667,086 A1; First Inventor: Ryma; Title: Spiral-Type Displacement Machine, in Particular a Displacement Machine for a Vehicle Air-Condtiioning System; Published: Jun. 17, 2020 (Year: 2020).*

Machine Translation of Foreign Patent Publication JP 2008-190448; First Inventor: Fukuda; Title: Filter and Refrigerant Compressor; Published: Aug. 21, 2008 (Year: 2008).*

* cited by examiner

FILTER-AND-THROTTLE UNIT FOR A SCROLL COMPRESSOR, AND SCROLL COMPRESSOR FOR A REFRIGERANT CIRCUIT

CROSS REFERENCE TO PRIOR APPLICATIONS

This application is a U.S. National Phase application under 35 U.S.C. § 371 of International Application No. PCT/EP2020/078292, filed on Oct. 8, 2020. The International Application was published in German on Apr. 14, 2022 as WO 2022/073611 A1 under PCT Article 21(2).

FIELD

The present invention relates to a filter and throttle unit for a scroll compressor, the filter and throttle unit comprising a housing with housing walls and an opening acting as a throttle or orifice, which is configured in one of the housing walls. The present invention also relates to a scroll compressor for a refrigerant circuit with a drive unit, an eccentric unit which can be driven by the drive unit and via which an orbiting displacement scroll can be moved, which engages in a stationary stator scroll, at least one displacement chamber between the stator scroll and the displacement scroll, and a high-pressure chamber into which the at least one displacement chamber opens, a low-pressure chamber which opens into the at least one displacement chamber, an oil return channel via which the high-pressure chamber is fluidically connected to the low-pressure chamber, a counterpressure chamber configured on the side of the displacement scroll facing away from the stator scroll, and a gas connection channel via which the counterpressure chamber is fluidically connected to the high-pressure chamber.

BACKGROUND

Such scroll compressors are in particular used for compressing refrigerants in refrigeration and air conditioning circuits of motor vehicles. The expanded refrigerant entering the scroll compressor is in a gaseous state and usually flows into the housing on the motor side, at least in the case of electric motor-driven scroll compressors, so that the refrigerant flows through the electric motor. The refrigerant also collects oil necessary for lubrication in the motor chamber, which is usually separated from the refrigerant in an oil separator on the scroll compressor and returned to the scroll compressor for lubrication. The compressed refrigerant returns to the refrigerant circuit via an outlet.

Such scroll compressors have previously been described, for example, in EP 3 404 264 A1 and comprise a high-pressure chamber, a low-pressure chamber, an orbiting displacement scroll, and a fixed stator scroll cooperating with the displacement scroll. The orbiting displacement scroll engages the stator scroll so that displacement chambers are defined between the displacement scroll and the stator scroll, in which the medium to be compressed is received and compressed. A counterpressure chamber is provided between the bearing housing of the compressor and the displacement scroll. The pressure prevailing in the counterpressure chamber and acting on the displacement scroll causes a resultant force in the axial direction, whereby the displacement scroll is pressed against the stationary scroll so that the scrolls are sealed with respect to each other.

A fluid connection between the high-pressure chamber and the counterpressure chamber via a gas connection channel exists to create the contact pressure in the counterpressure chamber, whereby the fluid under high pressure from the high-pressure chamber is also present in the counterpressure chamber. A gas connection throttle or orifice is arranged in the gas connection channel, the gas connection throttle or orifice controlling the mass flow of the fluid flowing into the counterpressure chamber and reducing the pressure.

The scroll compressor also comprises an oil return channel which fluidically connects the high-pressure chamber to the low pressure chamber. An oil intended for lubricating the components in the scroll compressor is separated from the compressed fluid via a separator which is arranged in the high-pressure chamber and which is returned to the low-pressure chamber via the oil return channel so that the returned oil can again be used to lubricate the components. An oil return throttle is arranged in the oil return channel to reduce the pressure of the returned oil.

A scroll compressor is also described in US 2005/0129556 A1 where a filter element is arranged in the oil return line in addition to the throttle in order to filter contaminants from the oil.

The disadvantage of the previously described scroll compressors is that either no filtering of the recirculated gas and oil takes place at all or that the effort to manufacture and install the filter element and the throttle is very high. A clogging of the filter elements in the return channels is also to be expected.

SUMMARY

An aspect of the present invention is to provide a filter and throttle unit that can be easily manufactured and installed in a scroll compressor with little effort. A further aspect of the present invention is to prevent a clogging of the filter elements in the scroll compressor.

In an embodiment, the present invention provides a filter and throttle unit for a scroll compressor. The filter and throttle unit includes a housing which comprises housing walls, an opening which is configured to act as a throttle, and a filter element which is arranged within the housing walls of the housing. The opening is arranged in one of the housing walls.

In an embodiment, the present invention also provides a scroll compressor for a refrigerant circuit. The scroll compressor includes a drive unit, a stationary stator scroll, an orbiting displacement scroll which is configured to be moved and to engage in the stationary stator scroll, an eccentric unit which is configured to be driven by the drive unit and via which the orbiting displacement scroll is movable, a high-pressure chamber, at least one displacement chamber which is arranged between the stationary stator scroll and the orbiting displacement scroll, a low-pressure chamber which is configured to open into the at least one displacement chamber, an oil return channel which is arranged to fluidically connect the high-pressure chamber to the low-pressure chamber, a counterpressure chamber which is arranged on a side of the orbiting displacement scroll which faces away from the stationary stator scroll, a gas connection channel which is arranged to fluidically connect the counterpressure chamber to the high-pressure chamber, and a filter and throttle unit. The at least one displacement chamber is configured to open into the high-pressure chamber. The filter and throttle unit is arranged in at least one of the gas connection channel and in the oil return channel.

BRIEF DESCRIPTION OF THE DRAWINGS

The present invention is described in greater detail below on the basis of embodiments and of the drawings in which.

DETAILED DESCRIPTION

Figure 1:
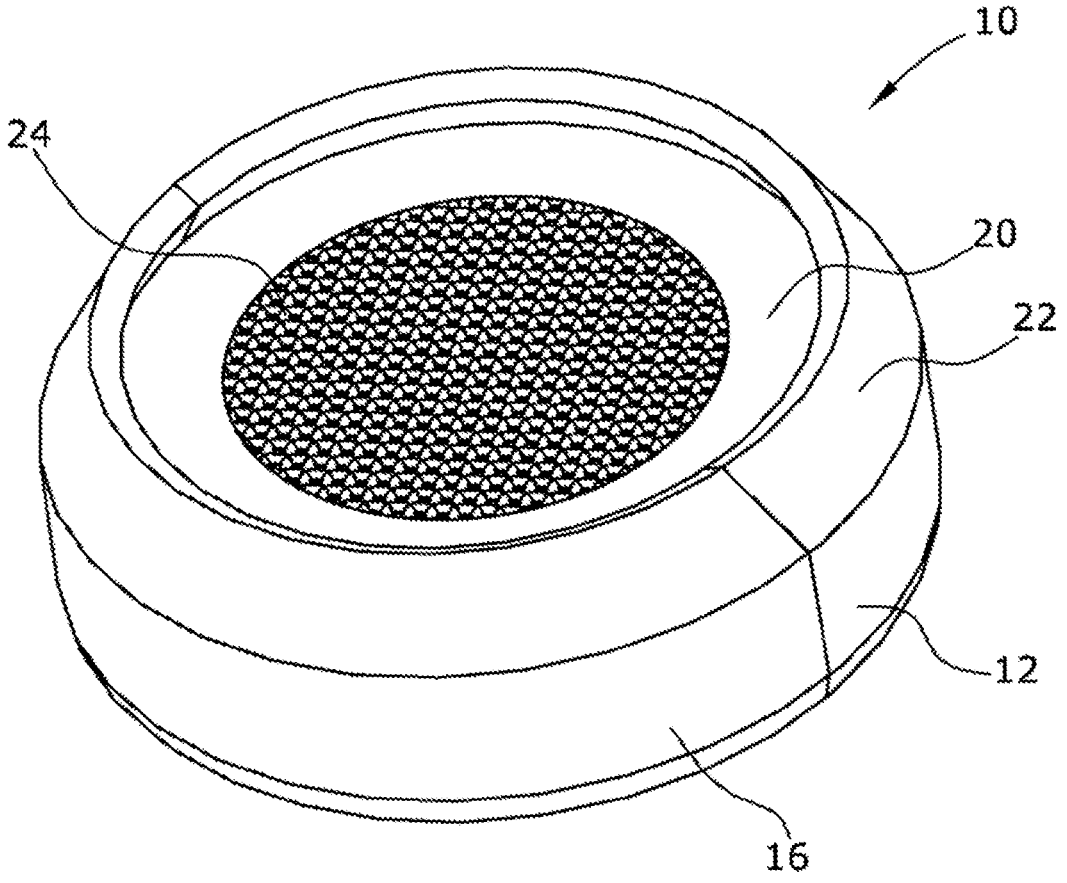
FIG. 1 shows a perspective view of a throttle and filter unit according to the present invention.

The filter and throttle unit for a scroll compressor according to the present invention comprises a housing with housing walls which define an outer wall of the filter and throttle unit and thus delimit the unit axially and radially. An opening serving as a throttle or orifice is configured in one of these delimiting walls. A filter element is also arranged within the housing walls, and is thus also delimited at least radially by the housing walls. A unit consisting of throttle or orifice and filter element is accordingly provided which can simply be inserted as a whole into a corresponding receptacle on the scroll compressor. Assembly is thereby significantly simplified. Manufacturing is also simplified since the housing wall directly serves as a throttle or orifice through the configuration of the opening, so that no need exists to mount additional components therefor.

The scroll compressor according to the present invention comprises a drive unit, which can in particular be an electric motor. The drive unit drives an eccentric unit which is motion-coupled with a displacement scroll so that it performs an orbiting, i.e., an eccentric, rotational movement. The displacement scroll is usually arranged on a sliding disk and engages with a stationary stator scroll, which with the displacement scroll delimits one or more displacement chambers, which are reduced when the displacement scroll rotates along the stator scroll, so that a compression of the medium takes place in the circulating displacement chambers. The last displacement chamber opens into a high-pressure chamber into which the compressed medium flows, for example, via an outlet valve. The scroll compressor additionally comprises a low-pressure chamber which opens into the outer displacement chamber and which serves as an inlet, wherein the entire space in which the electric motor can be arranged also defines the low-pressure chamber. This is accordingly defined by the entire enclosed space of the scroll compressor, in which the fluid to be compressed is present in a relaxed state, in which it also flows into the scroll compressor. An oil return channel is also configured via which the high-pressure chamber is fluidically connected to the low-pressure chamber, wherein the fluidic connection is usually not direct, but via an oil separation chamber. The scroll compressor also comprises a counterpressure chamber which is configured on the side of the displacement scroll facing away from the stator spiral, wherein a gas connection channel fluidically connects the counterpressure chamber with the high-pressure chamber so as to generate a counterpressure via which the displacement scroll is loaded against the stator spiral. The present invention provides that the filter and throttle unit is arranged in the gas connection duct and/or in the oil return duct, which comprises a housing with housing walls delimiting the filter and throttle unit to the outside. An opening serving as a throttle or orifice is configured in one of these limiting walls of the filter and throttle unit. A filter element is also arranged within a space delimited by the housing walls. This configuration of a filter and throttle unit allows for an easy insertion of the unit consisting of filter and throttle or orifice into a corresponding receiving opening in the scroll compressor in one assembly step. The unit can be attached by simply pressing it into place. The unit consisting of throttle or orifice and filter remains easily accessible and replaceable.

With regard to the filter and throttle unit, it is advantageous if the housing comprises an axially delimiting housing wall in which the opening serving as a throttle or orifice is configured, and an annular, radially delimiting housing wall which extends axially from the axially delimiting housing wall. A substantially pot-shaped component is accordingly provided, the housing of which does not require further assembly, but which can be manufactured in one piece.

In an embodiment of the present invention, the filter element can, for example, be configured in the form of a plate so as to delimit the filter and throttle unit on one axial side. This makes the filter element easily accessible and mountable in the housing. The plate-shaped design provides a surface of the filter element, especially for horizontally arranged compressors, which can be arranged perpendicular to the gravitational force so that a self-cleaning of the filter element takes place without external forces. The filtered-out solids do not thereby stick to the filter element even during the operation thereof.

In an embodiment of the present invention, the filter element can, for example, be configured as a filter screen which is radially delimited by a sealing element which is attached in the housing. The sealing element provides that no oil or gas can flow alongside the filter element. The screen comprises a sufficient filtering effect with high durability. The filter screen can also be easily attached to the housing via the sealing element.

In an embodiment of the present invention, the housing can, for example, be configured as a stamped part in which the filter element is attached in a form-locking manner with the sealing element. The design as a stamped part is just as cost-effective as the form-locking attachment of the filter element with the sealing element. This attachment can be produced, for example, by simply deforming the axial end of the annular housing wall.

In an embodiment of the present invention, the sealing element can, for example, rest with a first axial side against the axially delimiting housing wall and with its opposite axial side against an at least partially radially inwardly extending collar of the radially delimiting housing wall. The form-locking connection between the sealing element and the housing can thereby be established in a simple manner.

A tight connection is achieved when the sealing element is axially pressed between the collar and the axially delimiting housing wall, thereby providing that the gas or oil can flow exclusively via the filter element, which is surrounded by the seal.

The filter screen can, for example, be overmolded radially on the outside with a plastic of the sealing element so that the filter screen with the sealing element can be inserted as one part into the housing and attached thereto. This further facilitates assembly and manufacture. The filter screen can alternatively be inserted between two pressed sealing elements within the housing or attached between the collar and a sealing element.

In an embodiment of the scroll compressor according to the present invention, at least a section of the gas connection channel and/or the oil return channel can, for example, extend through the stator scroll. These channels can be easily incorporated during the manufacture of the scroll so that no additional machining is necessary.

In an embodiment of the present invention, the filter and throttle unit can, for example, be attached in the stator scroll. The filter and throttle unit can in particular simply be inserted into the corresponding channels before the stator scroll is mounted in the compressor housing.

It is particularly advantageous if the filter and throttle unit is pressed into an inlet opening on a cover disc of the stator scroll, wherein the filter element is configured in the form of a plate and delimits the high-pressure chamber. The filter element in this case extends to the same height as the wall surface of the cover disc of the stator scroll delimiting the high-pressure chamber so that a common wall surface is defined. There is thus no space in which the filtered-out contaminants can settle in front of the filter element. In the usual horizontal design of the compressor, these contaminants will instead always fall from the surface of the filter element back into the high-pressure chamber due to the gravitational force, thereby preventing a clogging of the filter element.

The gas connection channel can, for example, extend from the high-pressure chamber through the stator scroll and a bearing housing part to the counterpressure chamber. Few components must thereby be precisely aligned with each other during assembly so that the channel can be easily manufactured.

The high-pressure chamber can, for example, be connected with an oil separation chamber in which an oil separator is arranged. This allows the oil to be separated and returned to the low-pressure chamber so that the oil load on downstream components can be kept low.

The oil return channel can, for example, extend from a lowest point of the oil separation chamber through a head housing part, the stator scroll, and the bearing housing part, to the low-pressure chamber. Such a division and arrangement provides for a complete recirculation of the oil and allows for easy manufacturing and assembling.

The inlet opening of the gas connection channel can, for example, be arranged upstream of the oil separator in the direction of flow of the gas so that a gas-oil mixture enters the counterpressure chamber, and thus the bearing housing, thereby providing that the bearings and moving parts present there are sufficiently lubricated.

A filter and throttle unit and a scroll compressor for a refrigerant circuit of a vehicle is thus provided with such a filter and throttle unit which can be easily manufactured and assembled. Costs are thus reduced both in the manufacture of the filter and throttle unit as well as in their assembly on the compressor. A self-cleaning of the filter element is also achieved which also prevents clogging of the return channels.

An example of a filter and throttle unit according to the present invention as well as a scroll compressor according to the present invention are shown in the drawings and are described in greater detail below.

Figure 2:
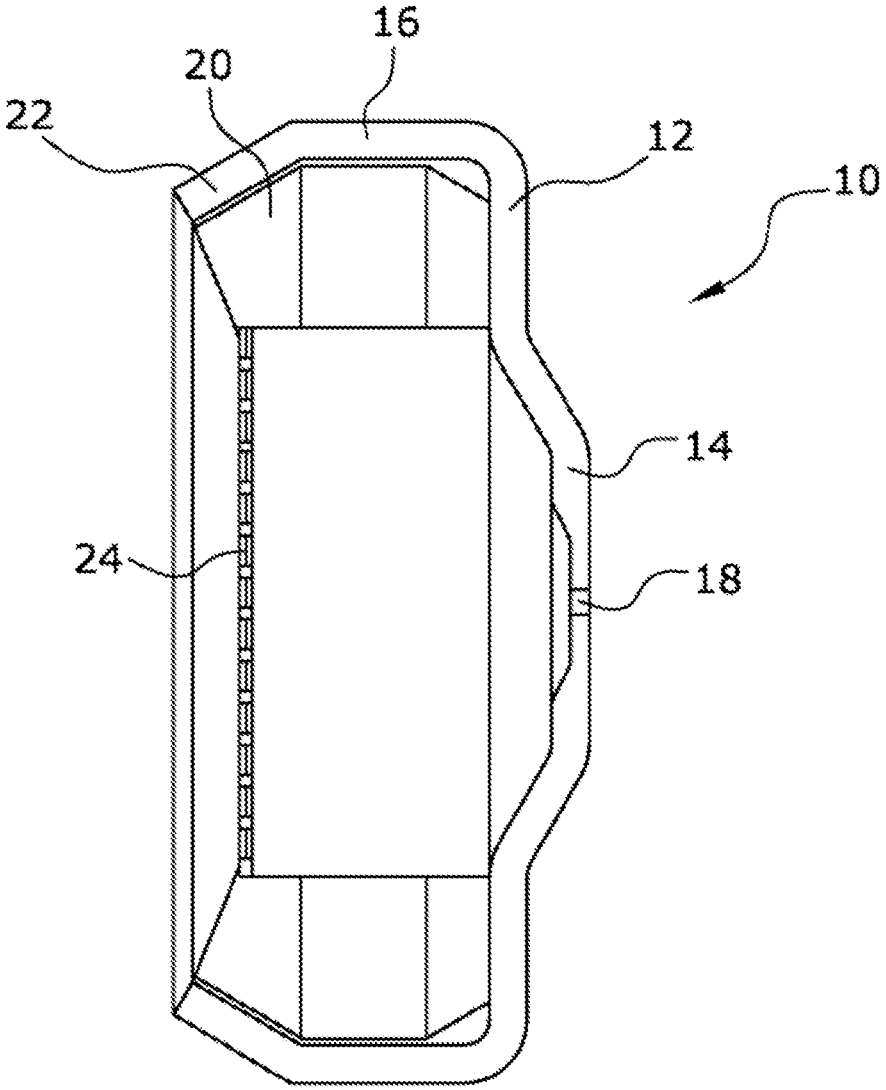
FIG. 2 shows a side view of the filter and throttle unit according to the present invention from FIG. 1 in a sectional view.

The filter and throttle unit 10 shown in FIGS. 1 and 2 comprises a housing 12 which consists of an axially delimiting housing wall 14, which is configured to be slightly thinner in the radially inner region in the present embodiment, and an annular housing wall 16 which delimits the filter and throttle unit 10 radially and which extends axially from the radially outer edge of the axially delimiting housing wall 14. This housing 12 can be produced particularly easily from sheet metal by punching and bending.

A narrow opening 18 serving as a throttle or orifice is configured in the inner thinner region of the axially delimiting housing wall 14. Inside the annular radially delimiting housing wall 16, an annular sealing element 20 is clamped and axially pressed between the axially delimiting housing wall 14 and an axial end section of the annular radially delimiting housing wall 16 formed as a collar 22, which is bent radially inwards. The first axial side of the sealing element 20 accordingly rests against the axially delimiting housing wall 14, and the opposite axial side of the sealing element 20 rests against the collar 22.

A filter element 24 which is configured as a filter screen is arranged on the open side of the housing 12, which filter element 24 is configured in the form of a plate and whose radially outer edge is either overmolded by the plastic of the sealing element 20 or is clamped axially between two sealing elements 20 or between the collar 22 and the sealing element 20. Oil or refrigerant can accordingly flow into the housing 12 via the filter element 24 so that solids are filtered out of the oil or refrigerant flow, and flow out of the filter and throttle unit 10 again via the opening 18 serving as a throttle or orifice, wherein the pressure downstream of the opening 18 is lower than the pressure upstream of the opening 18. The mass flow is also significantly reduced by the cross-sectional constriction.

Figure 3:
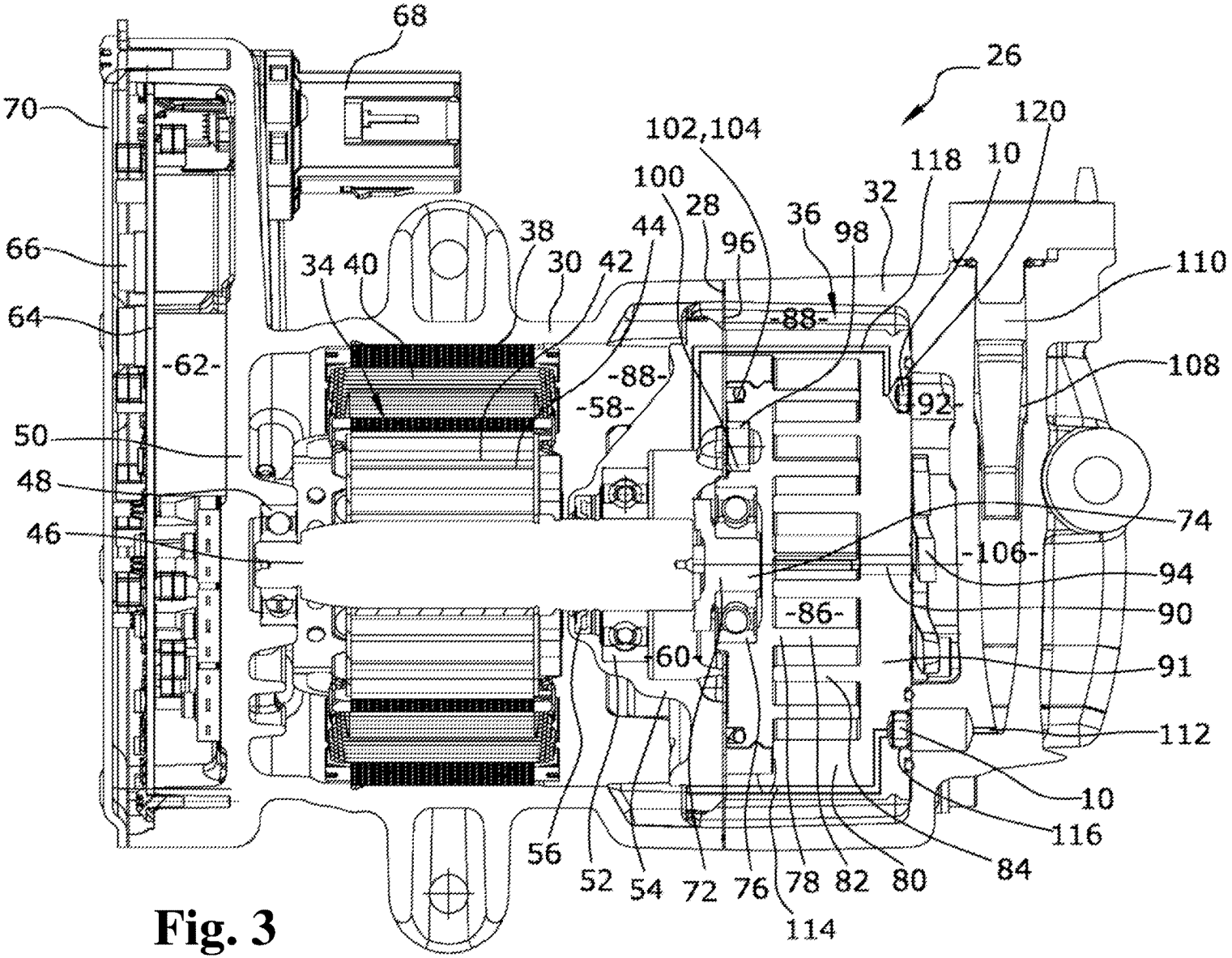
FIG. 3 shows a side view of a scroll compressor according to the present invention for a refrigerant circuit of a vehicle with a filter and throttle unit shown in FIGS. 1 and 2 in a sectional view.

FIG. 3 shows a scroll compressor 26 according to the present invention which comprises a multi-part compressor housing 28 with a first motor housing part 30 and a head housing part 32 axially adjoining the first motor housing part 30, wherein the first motor housing part 30 surrounds a drive unit 34 in the form of an electric motor, and the head housing part 32 surrounds a compressor chamber 36.

The drive unit 34 comprises a stator 38 with windings 40 and an internal rotor 42 with permanent magnets 44, which is attached to a shaft 46. The shaft 46 and thus the rotor 42 are mounted on one side via a first ball bearing 48, which is arranged in a receiving opening on an axially delimiting rear wall 50 of the first motor housing part 30, and on the other side via a second ball bearing 52, which is arranged in a receiving opening of a bearing housing part 54, which is attached on the side axially opposite the rear wall 50 in the radial interior of the first motor housing part 30. A shaft seal ring 56 is arranged in the bearing housing part 54 between the rotor 42 and the second ball bearing 52, via which a motor chamber 58 in which the drive unit 34 is arranged is sealed with respect to a counterpressure chamber 60 which is configured on the axial side of the bearing housing part 54 opposite to the motor chamber 58.

An electronics chamber 62 is configured on the opposite side of the rear wall 50 to the drive unit 34, which drive unit 34 can be provided as an electric motor 34, in which electronics chamber 62 a circuit board 64 with the power electronics 66 is attached. This is in turn connected to the windings 40 of the stator 38 so that it can be energized in a controlled manner. The power electronics 66 are supplied with power via a plug 68 which extends parallel to the motor axis from the rear wall 50. The electronics chamber 62 is closed by a cover 70.

An eccentric unit 72 is arranged on the end of the shaft 46 facing the compressor chamber 36, on the output stud 74 of which an eccentric shaft bearing 76 is arranged, on which an orbiting displacement scroll 78 is eccentrically mounted, which corresponds with a stationary stator scroll 80, which is attached in the head housing part 32 and to the bearing housing part 54, so that, via an eccentric rotation of the orbiting displacement scroll 78, the walls 82 thereof slide along the walls 84 of the stationary stator scroll 80 to form a plurality of displacement chambers 86, thereby reducing the expansion of the displacement chambers 86 and thereby compressing the refrigerant drawn from a low pressure chamber 88. The inlet from the low-pressure chamber 88 into the displacement chambers 86 is configured radially between the head housing part 32 and the stationary stator scroll 80 so that the refrigerant is conveyed from the low-pressure chamber 88 radially inwards through the displacement chambers 86 towards an outlet 90, which is configured on a cover disk 91 of the stationary stator scroll 80, into a high-pressure chamber 92 via a non-return valve 94, which is configured as a leaf spring element. The low-pressure chamber 88 is supplied with refrigerant via a (not visible) compressor inlet through which the refrigerant flows into the motor chamber 58, which serves as the low-pressure chamber 88.

A sliding disk 96 is arranged between the bearing housing part 54 and the stationary stator scroll 80 and the orbiting displacement scroll 78, which is clamped in the radially outer region between the head housing part 32 and the first motor housing part 30. This sliding disk 96 also comprises openings through which a plurality of pins (which are not visible in the drawings) protrude from the bearing housing part 54 into corresponding receptacles 98 of the orbiting displacement scroll 78, on which sliding bushings 100 are arranged, via which the orbiting displacement scroll 78 is additionally slidingly mounted. The orbiting displacement scroll 78 also comprises a sliding and sealing ring 104 which is arranged in a circumferential groove 102 on the side facing the sliding disk 96. The orbiting displacement scroll 78 is accordingly arranged to slide with respect to the shaft 46 and the bearing housing part 54.

The high-pressure chamber 92 of the scroll compressor 26 is fluidically connected to an oil separation chamber 106 in which an oil separator 108 in the form of a cyclone is arranged so that the lighter, gaseous refrigerant, flows to a compressor outlet 110 while the liquid, and heavier, oil in the cyclone is separated from the refrigerant and drips to a lowest point of the oil separation chamber 106 defined by a bottom 112.

To discharge the oil deposited in the oil separation chamber 106, the beginning of an oil return channel 114 is provided at the bottom 112 of the oil separation chamber 106, which fluidically connects the oil separation chamber 106 and thus the high-pressure chamber 92 with the low pressure chamber 88 and the motor chamber 58, respectively. The oil return channel 114 extends through the head housing part 32, the stationary stator scroll 80, the sliding disk 96, and through the bearing housing part 54, into the motor chamber 58.

According to the present invention, the filter and throttle unit 10 is fitted, in particular pressed, into an inlet opening 116 of the oil return channel 114 at the cover disk 91 of the stationary stator scroll 80 so that the oil is returned to the motor chamber 58 with reduced pressure and filtered.

A gas communication channel 118 moreover extends from the high pressure chamber 92 through the stationary stator scroll 80, the sliding disk 96, and through the bearing housing part 54, into the counterpressure chamber 60, in which there is correspondingly a reduced pressure relative to the high pressure chamber 92 but an increased pressure relative to the low pressure chamber 88, whereby the orbiting displacement scroll 78 is loaded against the stationary stator scroll 80, resulting in an improved seal between the end faces of the orbiting displacement scroll 78 and the stationary stator scroll 80.

In order to adjust this pressure, a filter and throttle unit 10 according to the present invention is also located at an inlet opening 120 into the gas connection channel 118 at the cover disk 91 of the stationary stator scroll 80, the opening 18 of which is configured to correspond in size and which can be pressed into the inlet opening 120. The filter element 24 also prevents the penetration of contaminants into the counterpressure chamber 60, thus protecting the second ball bearings 52, the eccentric shaft bearings 76, the sliding bushings 100, the sliding disk 96, and the sliding and sealing ring 104 which are there arranged.

The filter surface of the filter element 24 is thus located approximately in one plane with the cover disk 91 of the stationary stator scroll 80 both at the inlet opening 120 of the gas connection channel 118 and at the inlet opening 116 of the oil return channel 114. Dirt there filtered out thus does not settle in the oil return channel 114 or in the gas connection channel 118 to clog them, but falls into the high pressure chamber 92 due to gravitational force. Self-cleaning thus takes place. The functionality of the oil return channel 114 and the gas connection channel 118 is accordingly maintained over a long period of time. The filter and throttle units 10 can accordingly be easily removed and replaced, as they are easily accessible and easy to assemble and disassemble. Different desired back pressures can also be set by filter and throttle units 10 with different opening widths.

It should be clear that the scope of protection of the present invention is not limited to the described embodiment example, but that various modifications are conceivable. The scroll compressor can, for example, comprise any drive or the housing divisions can be changed. The filter and throttle unit can also be attached in the inlet openings in a different way as by press-fitting. Reference should also be had to the appended claims.

LIST OF REFERENCE NUMERALS

10 Filter and throttle unit
12 Housing
14 Axially delimiting housing wall
16 Annular radially delimiting housing wall
18 Opening
20 Sealing element
22 Collar
24 Filter element
26 Scroll compressor
28 Multi-part compressor housing
30 First motor housing part
32 Head housing part
34 Drive unit/Electric motor
36 Compressor chamber
38 Stator
40 Windings
42 Rotor
44 Permanent magnet
46 Shaft
48 First ball bearing
50 Rear wall
52 Second ball bearing
54 Bearing housing part
56 Shaft seal ring
58 Motor chamber
60 Counterpressure chamber
62 Electronics chamber
64 Circuit board
66 Power electronics
68 Plug
70 Cover
72 Eccentric unit
74 Output stud
76 Eccentric shaft bearing

78 Orbiting displacement scroll
80 Stationary stator scroll
82 Walls
84 Walls
86 Displacement chambers
88 Low pressure chamber
90 Outlet
91 Cover disk
92 High pressure chamber
94 Non-return valve
96 Sliding disk
98 Receptacles (of the orbiting displacement scroll 78)
100 Sliding bushings
102 Circumferential groove
104 Sealing ring
106 Oil separation chamber
108 Oil separator
110 Compressor outlet
112 Bottom
114 Oil return channel
116 Inlet opening
118 Gas connection channel
120 Inlet opening

What is claimed is:

1. A filter and throttle unit for a scroll compressor, the filter and throttle unit comprising:
a housing which comprises housing walls;
an opening which is configured to act as a throttle, the opening being arranged in one of the housing walls;
a filter element which is arranged within the housing walls of the housing; and
a sealing element which is attached in the housing,
wherein,
the filter element has a plate form and is configured to delimit the filter and throttle unit on one axial side thereof,
the housing walls of the housing comprise,
an axially delimiting housing wall in which the opening is arranged, and
an annular radially delimiting housing wall which extends axially from the axially delimiting housing wall, and
the filter element is configured as a filter screen which is radially delimited by the sealing element.

2. The filter and throttle unit as recited in claim 1, wherein,
the housing is provided as a stamped part, and
the filter element is attached in a form-locking manner in the housing via the sealing element.

3. The filter and throttle unit as recited in claim 2, wherein,
the annular radially delimiting housing wall comprises an at least partially radially inwardly extending collar, and
the sealing element rests against the axially delimiting housing wall with a first axial side and rests against the at least partially radially inwardly extending collar of the annular radially delimiting housing wall with a second axial side which is opposite to the first axial side.

4. The filter and throttle unit as recited in claim 3, wherein the sealing element is axially pressed between the at least partially radially inwardly extending collar and the annular radially delimiting housing wall.

5. The filter and throttle unit as recited in claim 1, wherein,
the sealing element comprises a plastic, and
the filter element is overmolded radially on an outside with the plastic of the sealing element.

6. A scroll compressor for a refrigerant circuit, the scroll compressor comprising:
a drive unit;
a stationary stator scroll;
an orbiting displacement scroll which is configured to be moved and to engage in the stationary stator scroll;
an eccentric unit which is configured to be driven by the drive unit and via which the orbiting displacement scroll is movable;
a high-pressure chamber;
at least one displacement chamber which is arranged between the stationary stator scroll and the orbiting displacement scroll, the at least one displacement chamber being configured to open into the high-pressure chamber;
a low-pressure chamber which is configured to open into the at least one displacement chamber;
an oil return channel which is arranged to fluidically connect the high-pressure chamber to the low-pressure chamber;
a counterpressure chamber which is arranged on a side of the orbiting displacement scroll which faces away from the stationary stator scroll;
a gas connection channel which is arranged to fluidically connect the counterpressure chamber to the high-pressure chamber; and
the filter and throttle unit as recited in claim 1, the filter and throttle unit being arranged in at least one of the gas connection channel and in the oil return channel.

7. The scroll compressor as recited in claim 6, wherein at least one of,
a section of the gas connection channel extends through the stationary stator scroll, and
a section of the oil return channel extends through the stationary stator scroll.

8. The scroll compressor as recited in claim 7, wherein the filter and throttle unit is fixed within the stationary stator scroll.

9. The scroll compressor as recited in claim 8, wherein,
the stationary stator scroll comprises a cover disk which comprises an inlet opening,
the filter and throttle unit is pressed into the inlet opening on the cover disc of the stationary stator scroll, and
the filter element has a plate form and is configured to delimit the high-pressure chamber.

10. The scroll compressor as recited in claim 6, further comprising:
a bearing housing part,
wherein,
the gas connection channel is arranged to extend from the high-pressure chamber through the stationary stator scroll and the bearing housing part to the counterpressure chamber.

11. The scroll compressor as recited in claim 10, further comprising:
an oil separation chamber having an oil separator arranged therein,
wherein,
the high-pressure chamber is connected with the oil separation chamber.

12. The scroll compressor as recited in claim 11, further comprising:

a head housing part, wherein, the oil return channel is further arranged to extend from a lowest point of the oil separation chamber through the head housing part, the stationary stator scroll, and the bearing housing part, to the low-pressure chamber.

13. The scroll compressor as recited in claim 11, wherein, the gas connection channel comprises an inlet opening which is arranged upstream of the oil separator in a direction of flow of a gas.

* * * * *